US008915463B2

(12) United States Patent
Hagleitner

(10) Patent No.: US 8,915,463 B2
(45) Date of Patent: Dec. 23, 2014

(54) PAPER DISPENSER

(76) Inventor: Hans Georg Hagleitner, Zell Am See (AT)

( * ) Notice: Subject to any disclaimer, the term of this patent is extended or adjusted under 35 U.S.C. 154(b) by 976 days.

(21) Appl. No.: 12/365,490

(22) Filed: Feb. 4, 2009

(65) Prior Publication Data

US 2009/0179104 A1 Jul. 16, 2009

Related U.S. Application Data

(63) Continuation of application No. PCT/AT2007/000339, filed on Jul. 5, 2007.

(30) Foreign Application Priority Data

Aug. 4, 2006 (AT) ..... 1310/2006

(51) Int. Cl.

| | |
|---|---|
| ***B65H 75/18*** | (2006.01) |
| ***B65H 16/06*** | (2006.01) |
| ***B65H 75/00*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/3253* (2013.01)

USPC ..... 242/598.5; 242/598

(58) Field of Classification Search

USPC ..... 242/560, 560.1, 561, 598, 598.1, 598.4, 242/598.5, 560.2, 560.3, 594, 594.1, 595, 242/598.2, 598.3

See application file for complete search history.

(56) References Cited

U.S. PATENT DOCUMENTS

| | | | | | |
|---|---|---|---|---|---|
| 2,299,301 | A | * | 10/1942 | Britt et al. | 242/560.3 |
| 2,839,346 | A | | 6/1958 | Lawalin | |
| 3,770,222 | A | * | 11/1973 | Jespersen | 242/560.3 |
| 3,771,739 | A | * | 11/1973 | Nelson | 242/560.3 |
| 4,944,466 | A | * | 7/1990 | Jespersen | 242/560.3 |
| 5,271,574 | A | * | 12/1993 | Formon et al. | 242/560.3 |
| 5,288,032 | A | * | 2/1994 | Boone et al. | 242/560.3 |
| 5,558,302 | A | | 9/1996 | Jesperson | |
| 5,762,285 | A | * | 6/1998 | Lin | 242/565 |
| 7,338,007 | B2 | * | 3/2008 | Valot | 242/559 |

FOREIGN PATENT DOCUMENTS

| | | | | | |
|---|---|---|---|---|---|
| DE | 20116430 | U1 | | 11/2001 | |
| GB | 888012 | A | | 1/1962 | |
| GB | 1422674 | | * | 9/1973 | B65H 75/00 |
| GB | 1422674 | A | | 1/1976 | |
| GB | 2193703 | A | | 2/1988 | |
| WO | 9304965 | A1 | | 3/1993 | |

OTHER PUBLICATIONS

International Search Report dated Dec. 12, 2007.

* cited by examiner

*Primary Examiner* — Michael Mansen
*Assistant Examiner* — Juan Campos, Jr.
(74) *Attorney, Agent, or Firm* — Laurence A. Greenberg; Werner H. Stemer; Ralph E. Locher

(57) ABSTRACT

A paper dispenser has a dispensing opening for paper and also a first roll, which is located in a dispensing position, and a guide path, which leads into the dispensing position and contains a storage position for a reserve roll. The dispensing opening is of a size which, once the first roll has been used up, allows manual access to the paper of the reserve roll, while the reserve roll is still in the storage position.

11 Claims, 6 Drawing Sheets

PAPER DISPENSER

CROSS-REFERENCE TO RELATED APPLICATION

This is a continuation application, under 35 U.S.C. §120, of copending international application No. PCT/AT2007/000339, filed Jul. 5, 2007, which designated the United States; this application also claims the priority, under 35 U.S.C. §119, of Austrian patent application No. A 1310/2006, filed Aug. 4, 2006; the prior applications are herewith incorporated by reference in their entirety.

BACKGROUND OF THE INVENTION

Field of the Invention

The invention relates to a paper dispenser having an outlet opening for paper from a first reel which lies in a dispensing position and further has a guide track which leads into the dispensing position and in which a storage position is provided for a reserve reel.

Dispensers of this type, in particular for toilet paper, have been used for a long time in a multiplicity of embodiments and have the common basic concept that, when the paper has been used up, recourse can be made to the paper of the reserve reel—with timely refilling of course being presupposed. Dispensers, in which two reels can be accommodated, have to be larger than those in which the refilling is not possible until the reel is partially used up and therefore have to have only a holding capacity of approximately one and a half reels. U.S. Pat. No. 2,839,346 discloses a simple example for a two reel dispenser and U.S. Pat. No. 5,558,302 discloses a simple example for a one and a half reel dispenser.

A fundamental problem of dispensers with a reserve reel lies in the fact that no position can be defined for the start of the paper strip on the circumference of the reel in the case of a reserve reel which follows through into the dispensing position. In known dispensers, solutions for moving, transfer and threading mechanisms are therefore proposed which are intended to ensure the continuous paper output after the first reel has been used up, the problems not appearing to be solved really, however. As a deviation from this, it is also known to press the reserve roll which rests on resilient tongues downwards by hand after the dispensing reel has been used up (GB 888 012), an additional opening being provided in the housing for access.

SUMMARY OF THE INVENTION

It is accordingly an object of the invention to provide a paper dispenser which overcomes the above-mentioned disadvantages of the prior art devices and methods of this general type.

With the foregoing and other objects in view there is provided, in accordance with the invention, a paper dispenser. The paper dispenser contains a housing having an outlet opening formed therein for paper from a first reel lying in a dispensing position, and a guide track leading into the dispensing position and into a storage position for a reserve reel. The outlet opening has a size which, after the first reel has been used up, makes it possible to access paper of the reserve reel by hand.

The invention takes another approach and as a result arrives at a paper dispenser which also continues to provide paper in a very simple way and without the abovementioned mechanisms when the first reel has been used up. This is achieved by the fact that the outlet opening has a size which, after the first reel has been used up, makes it possible to access the paper of the reserve reel which lies in the storage position by hand. In this way, without the reserve reel sliding down into the dispensing position, the reserve reel can be turned by hand, in order to grip the paper strip which can then be pulled through the output opening and torn off. From this instant, the paper is also ready for gripping in the storage position just like the paper of the first reel previously was in the dispensing position.

Since the access to the storage reel is necessary only at the above-described instant, there is preferably provision for the first reel to cover the outlet opening at least partially, with the result that the height of the outlet opening increases as the reel diameter decreases. In a first embodiment, the storage position is preferably defined by a constriction in the guide track, which constriction can limit the passage radially and/or axially for the reel into the dispensing position. In the case of radial limitation, the width of the constriction which holds the reserve reel back corresponds, for example, to half the diameter, preferably only approximately a third of the diameter of the reserve reel, with the result that the reserve reel lies at the constriction for a relatively long period of its use and is mounted, in particular, on the circumference. Here, the radial boundary of the constriction and simultaneous circumferential mounting of the reserve reel can be formed by a supporting roller which is provided there and can preferably be deflected in a spring loaded manner by approximately from two to five millimeters, in order, for example, not to jam unround paper reels. As an alternative, a braking tab or the like which presses against the circumference of the reel in a sprung manner can also be provided at the constriction.

A second radial constriction of the guide track is preferably provided in the dispensing position, the width of the second radial constriction is as small as possible, in order to use up the paper of the first reel completely. The reels are preferably mounted on cores or mandrels, the width of the second constriction corresponding to the diameter of the core or mandrel. A supporting roller can also be provided at the constriction, which supporting roller is optionally likewise deflected in a spring loaded manner and can act in a braking manner on the paper reel which lies on it. The arrangement of a second spring braking tab instead of the supporting roller is also possible here.

The braking tabs which are arranged in a sprung manner and are composed, in particular, of an elastic material can have surface roughnesses which increase friction. At any rate, they are intended to brake in such a way that pulling off a relatively great length of paper with impetus is made more difficult or avoided.

Neutral paper can be inserted as desired into the dispenser, that is to say it is unimportant whether the paper is pulled off to the front or to the rear. However, if the reel contains paper which is printed on one side, the printing should be visible, that is to say the printed side should point to the front during pulling off. For this case, there is preferably provision for the braking tab of the constriction for the storage position to extend in the unrolling direction and for the braking tab of the constriction for the dispensing position to extend counter to the unrolling position.

If the paper dispenser has the above-described second constriction for the dispensing position, the mandrel or core which remains after the paper has been used up is caught below the dispensing position and can be removed, for example at the same time as a new reserve reel is refilled. However, an embodiment is also conceivable, in which the dispensing position is not defined by a second constriction but rather by the end of the guide track, and the remaining core remains lying there until removal. If, in this embodiment, the reserve reel has been used up to such an extent that it passes the first constriction and the dispensing position is still occupied by the empty core or mandrel, an auxiliary dispensing position is provided for the first reel preferably sufficiently above the dispensing position of the first reel, in order that the latter does not lie on the empty core. The removal of paper is naturally also possible without problems in the auxiliary dispensing position thanks to the large outlet opening.

In a further embodiment, the guide track can have a receiving groove for a bearing journal on at least one side of the dispenser housing, which bearing journal projects out of the reel and forms the end of the core or mandrel. In this embodiment, the constriction in the guide track can be formed by a removable supporting element for the bearing journal, which bearing journal engages into the receiving groove, for example in the form of a rotatably mounted, in particular spring loaded angled lever. Here, in one preferred embodiment, an axial constriction is provided for the storage position, that is to say the supporting element on the first arm of the lever, the second arm of which bears against the reserve reel on the end side, shortens the axial clearance for the reserve reel. The second arm cannot pivot in above the reserve reel until the diameter of the latter is reduced. If the second arm has pivoted in to a sufficient extent, the first arm of the angled lever no longer protrudes into the receiving groove and the bearing journal of the reserve reel is free, it then being possible for the reserve reel to slide downward into the dispensing position. If the angled lever is made from a resilient material, it can also serve as end side reel brake.

A second pivotable lever having a supporting element can fix the auxiliary dispensing position if the lower second lever arm is displaced to the outside out of the receiving groove by that core or mandrel of the used first reel which has not yet been removed. If the empty mandrel or core is removed, the lever pivots, preferably under the action of a spring, and releases the auxiliary dispensing position, with the result that the reel which lies there slides further downward and pivots the lever back again. In this embodiment, the constriction is radial, that is to say the pivot axis as a lever lies parallel to the bearing journal and the supporting element enters and exits radially to the side.

There can be provision in a further preferred embodiment for at least the dispensing position of the first reel, optionally also the storage position of the reserve reel, to be assigned a reel brake which acts on the end side.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
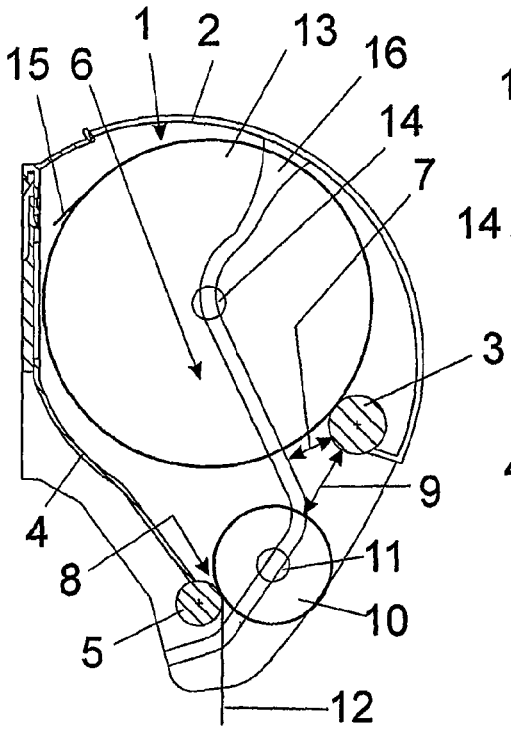
FIGS. 1 to 8 are diagrammatic, sectional views through a first embodiment of a paper dispenser in different use phases, in which first embodiment the paper is pulled off on a rear side of a reel according to the invention.
Figure 2:
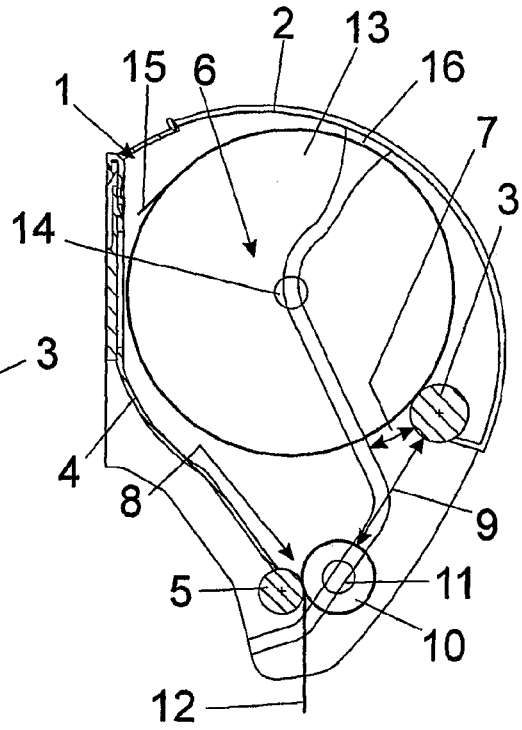

Referring now to the figures of the drawing in detail and first, particularly, to FIGS. 1-8 thereof, there is shown a paper dispenser, in particular for toilet paper which is provided with tear off perforations, or other cleaning or hygiene papers. The paper dispenser has a housing 1 which is mounted, for example, on a wall and has a front, in particular a lockable cover 2 of an upper housing part, optionally with a viewing window 22, and an oblique rear wall 4 on a lower housing part. In the first embodiment which is shown in FIGS. 1 to 8, the cover 2 and the wall 4 end at a supporting roller 3, 5, it being possible for the cover 2 to pivot about the axis of the supporting roller 3. The supporting rollers 3, 5 are preferably of a sprung configuration. The housing 1 is open between the supporting rollers 3 and 5 and the two rollers 3, 5 delimit an outlet opening 9 for paper 12 or 15 which is to be dispensed. The paper dispenser can receive a first reel 10 which is in use and a reserve reel 13 which is arranged above the first reel 10 and can be reached by pivoting up the cover 2. A guide track which is denoted in general by 6 and becomes narrower to the bottom in two stages extends from a receiving space of the reserve reel 13 in the direction of a dispensing position of the first reel 10. Angled receiving grooves 16 for those bearing journals of the cores or mandrels 11, 14 which project from the reels 10, 13 extend in the side walls of the housing 1. The guide track 6 is delimited in an upper region by the receiving groove 16 and the supporting roller 3 on the cover 2 and in the lower region by the receiving groove 16 and the supporting roller 5. An upper constriction 7 which limits the diameter and at which the receiving groove 16 is approximated to the supporting roller 3 and a lower constriction 8 which limits the diameter and at which the receiving groove 16 adjoins the supporting roller 5 being formed. As a result, the width of the lower radial constriction 8 is limited substantially to the diameter of the core or mandrel 11 of the first reel 10. The width of the upper radial constriction 7 lies approximately at a third of the diameter of the reserve reel 13.

In the following text, the use of the paper dispenser will be explained using the instantaneous illustrations which are shown in FIGS. 1 to 8.

Figure 3:
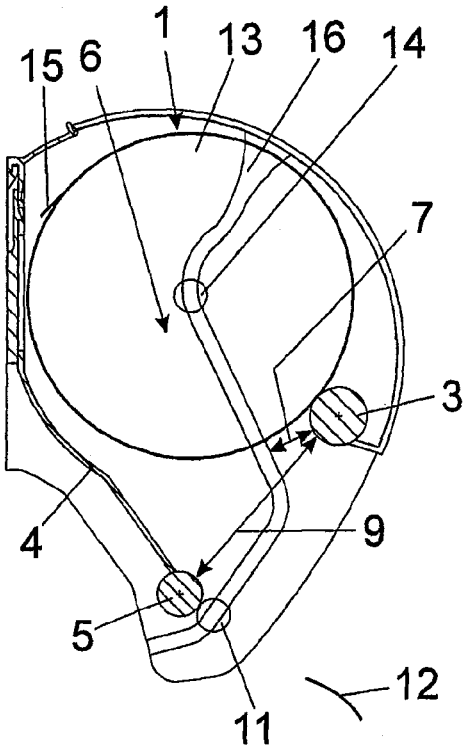
Figure 4:
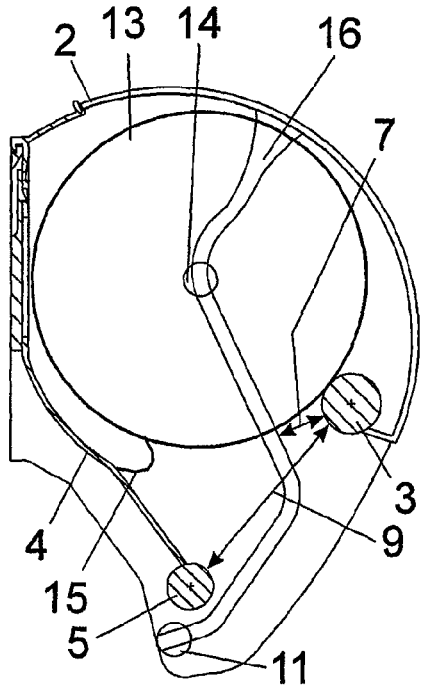
Figure 5:
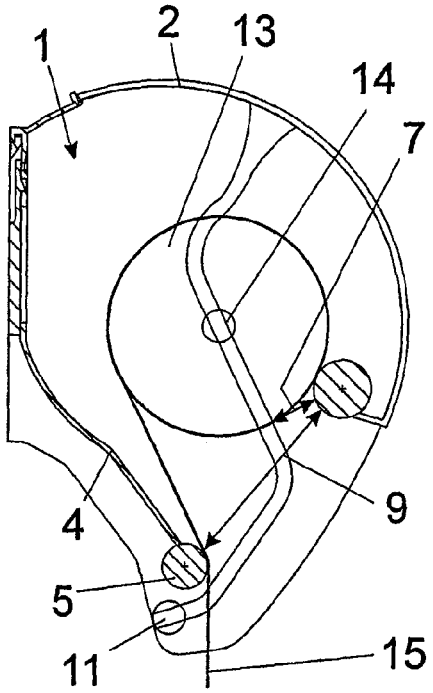
Figure 6:
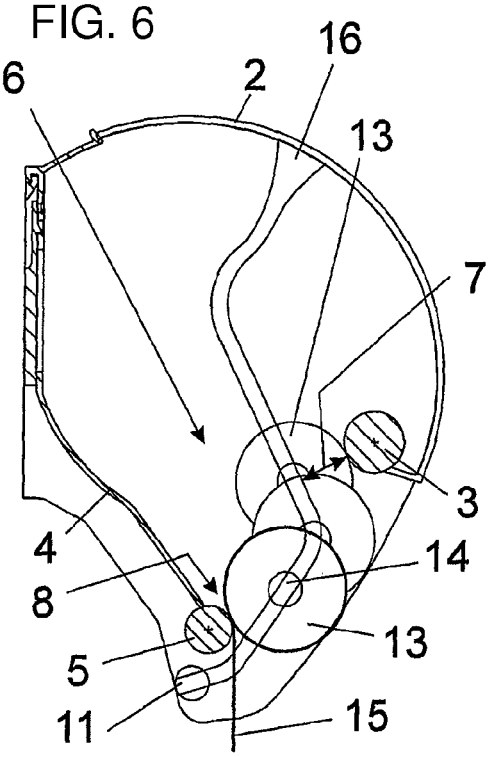
Figure 7:
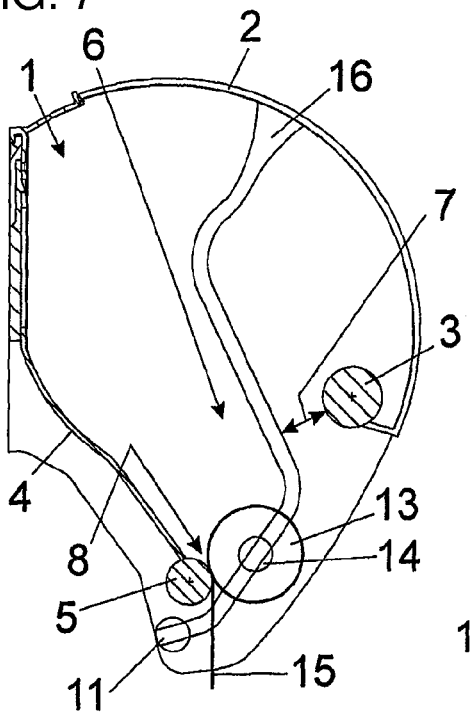
Figure 8:
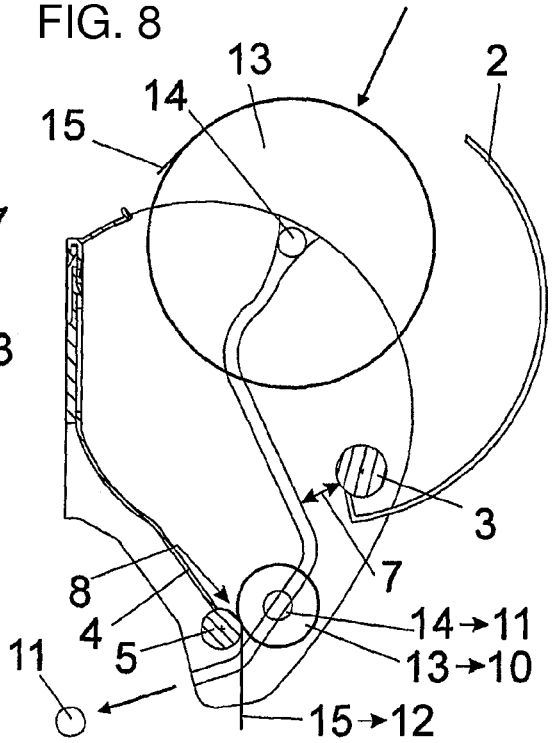
Figure 9:
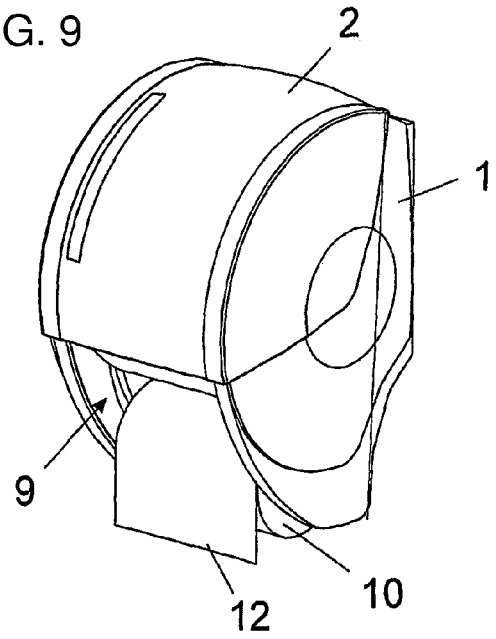
FIG. 9 is a diagrammatic, perspective view of a second embodiment of the paper dispenser, in which second embodiment the paper is pulled off on the front side of the reel.
Figure 10:
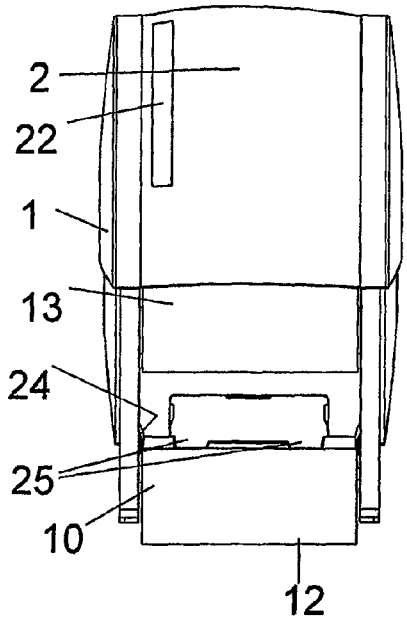
FIG. 10 is a diagrammatic, front view of the embodiment from FIG. 9.

FIG. 1 shows the completely filled paper dispenser with the first reel 10 in the dispensing position and the reserve reel 13 in the storage position, the reels 10, 13 lying on constrictions 7 and 8, that is to say on the supporting rollers 3 and 5. Paper 12 is pulled off from the first reel 10, the diameter of which is reduced (FIG. 2), the height of the outlet opening 9 increasing. In FIG. 3, the first reel is used up and, after removal of the last sheet of paper 12, the remaining core or mandrel 11 can pass the constriction 8 and awaits its disposal at the end of the receptacle at the bottom 16, where it is outside the space which is required for the removal of paper. The reserve reel 13 which is stationary at the storage position at the upper constriction 7 can be gripped by the user through the outlet opening 9 which is then at its maximum, and the user can turn the reserve reel 13 by hand as desired according to FIG. 4, until the start of the paper 15 protrudes to the bottom and the paper 15 can be pulled off. This takes place continuously, the reserve reel 13 becoming smaller (FIG. 5), until its diameter corresponds to the width of the constriction 7. From this moment, the rest of the reserve reel 13 can slide further downward (FIG. 6) until it passes into the dispensing position, in which it lies on the supporting roller 5 of the second constriction 8, just like the first reel 10 did previously (FIG. 7). The paper dispenser can then be maintained, that is to say a new reserve reel 13 is inserted from the top and the empty mandrel 11 is removed, as can be seen from the somewhat smaller illustration of FIG. 8. As a result, that rest of the reserve reel 13 which lies at the bottom becomes a first reel 10 in the dispensing position, from which paper 15=12 continues to be pulled off until the end. The phase according to FIG. 1 begins again.

In the second embodiment according to FIGS. 9 to 15, the reels 10, 13 are inserted in such a way that the paper 12, 15 is accessible at the front and any print which might exist can be seen. The guide track 6 has a similar course to the first embodiment and likewise becomes narrower to the bottom in two steps. Braking tabs 23, 25 which press against the circumference of the reserve reel 13 and the first reel 10 in a spring manner are arranged at the radial constrictions 7, 8 which form the steps, of which braking tabs 23, 25 the upper braking tab 23 extends in the unrolling direction and the lower braking tab 25 extends counter to the unrolling direction, as a result of which the latter has a greater braking action. Those surfaces of the braking tabs which lie on the reel 10, 13 can have a surface configuration which modifies the friction. Furthermore, the guide track 6 and/or the receiving groove 16 can also be assigned a reel brake 24 which presses on the end side against the reel 10, 13, in the form of a sprung tongue or the like.

Figure 11:
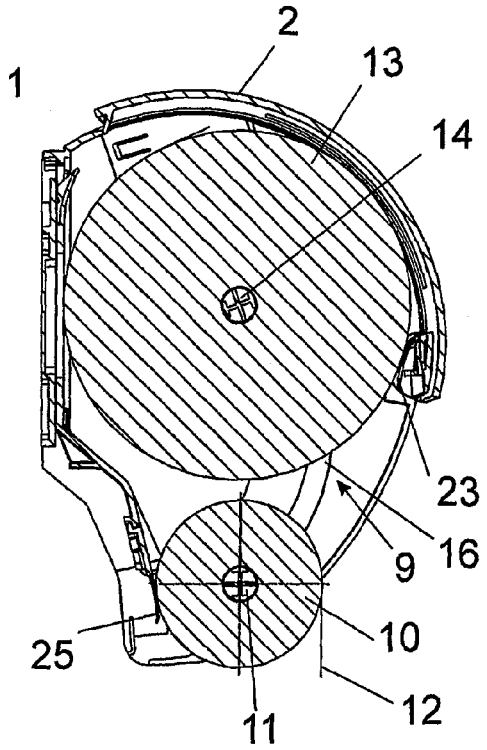
FIGS. 11 to 15 are diagrammatic, sectional views through the second embodiment of the paper dispenser.
Figure 12:
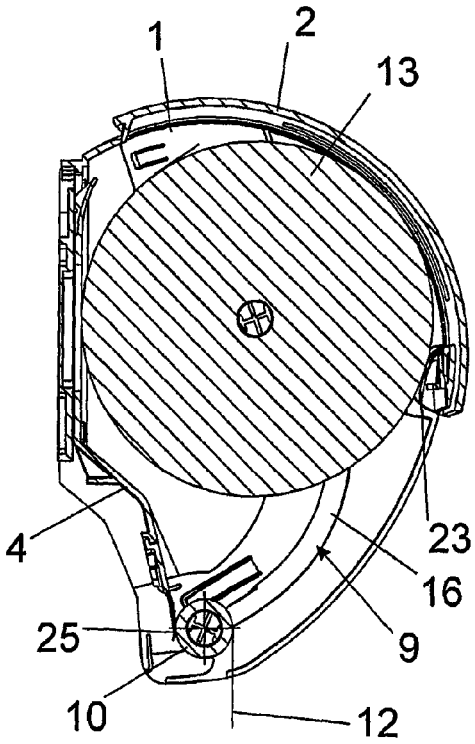
Figure 13:
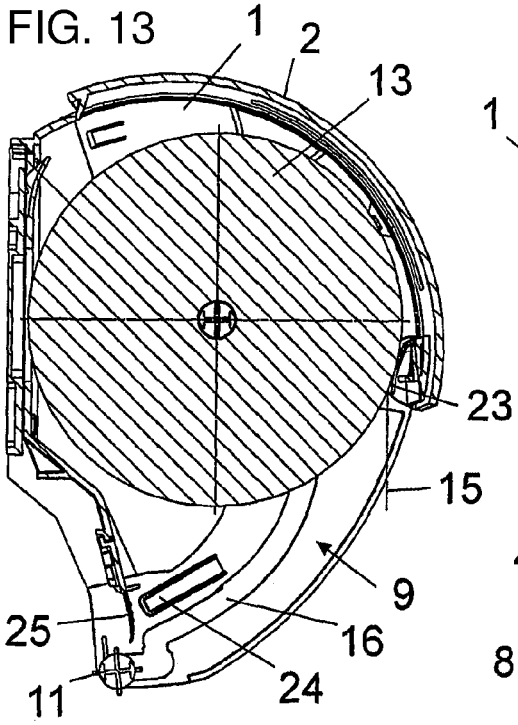
Figure 14:
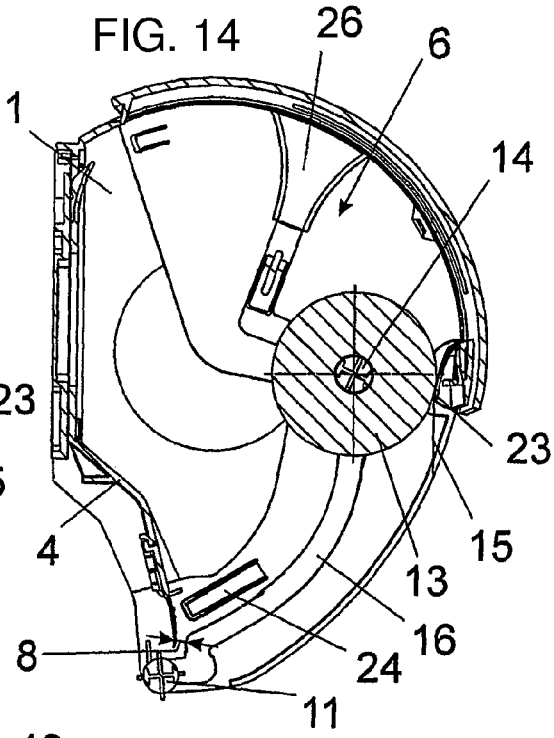

There is no difference in the use of the paper dispenser of FIGS. 9 to 15 from the first embodiment according to FIGS. 1 to 8. FIG. 11 shows the paper dispenser with a new reserve reel 13 and a first reel 10 which has a maximum diameter and has just passed the first constriction 7. FIG. 12 shows the first reel 10 which has already almost been used up. In FIG. 13, the empty core or mandrel 11 of the first reel 10 lies at the lower end of the guide track, and paper 15 is pulled off from the reserve reel 13 in its storage position until its diameter is so small that the first constriction 7 can be passed, as shown in FIG. 14.

Figure 15:
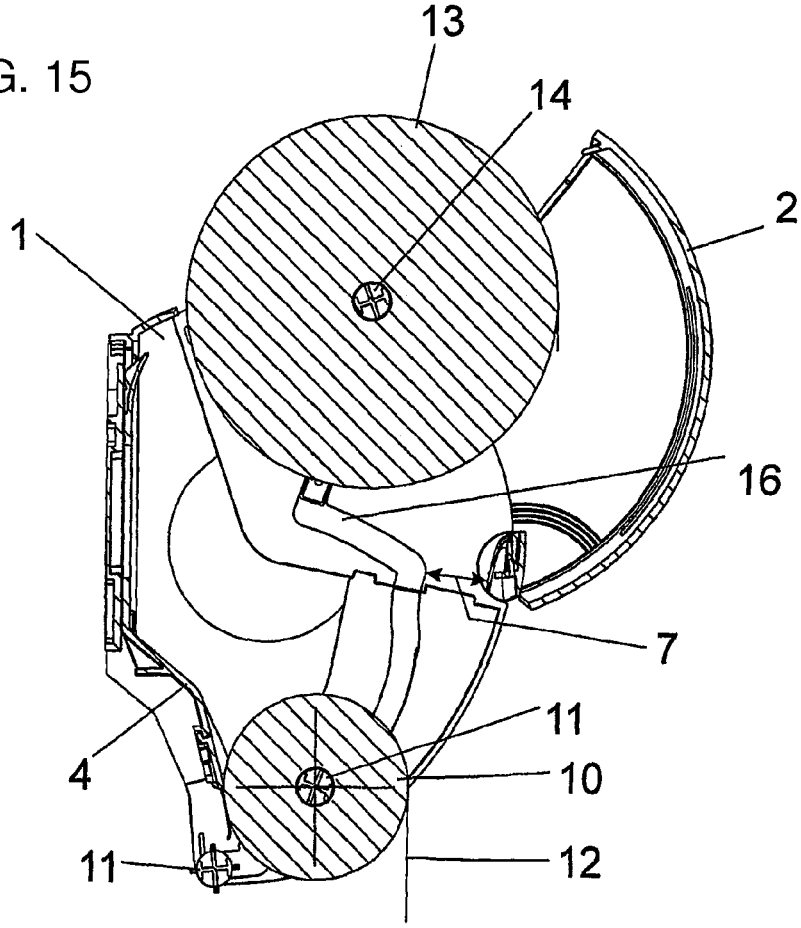

FIG. 15 shows the maintenance of the paper dispenser, a new reserve reel 13 being inserted and the empty core or mandrel 11 being removed. In the initial section 26 of the receiving groove 16, inserts can be provided which define a corresponding diametrically opposed shape of the projecting bearing journal 14 of the core or mandrel.

Figure 16:
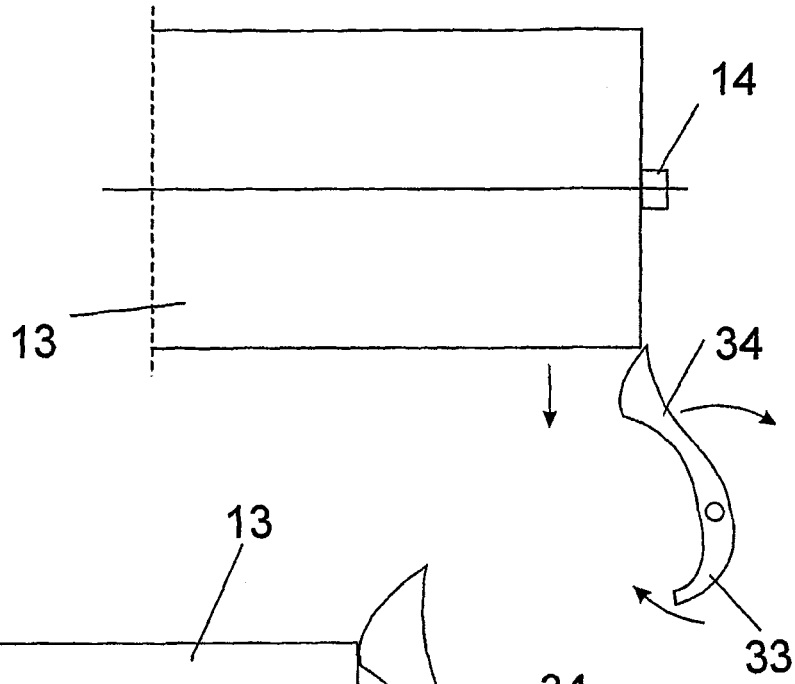
FIG. 16 to 18 are illustrations showing details for retaining a reserve reel in the storage position in a third embodiment of a paper dispenser.
Figure 17:
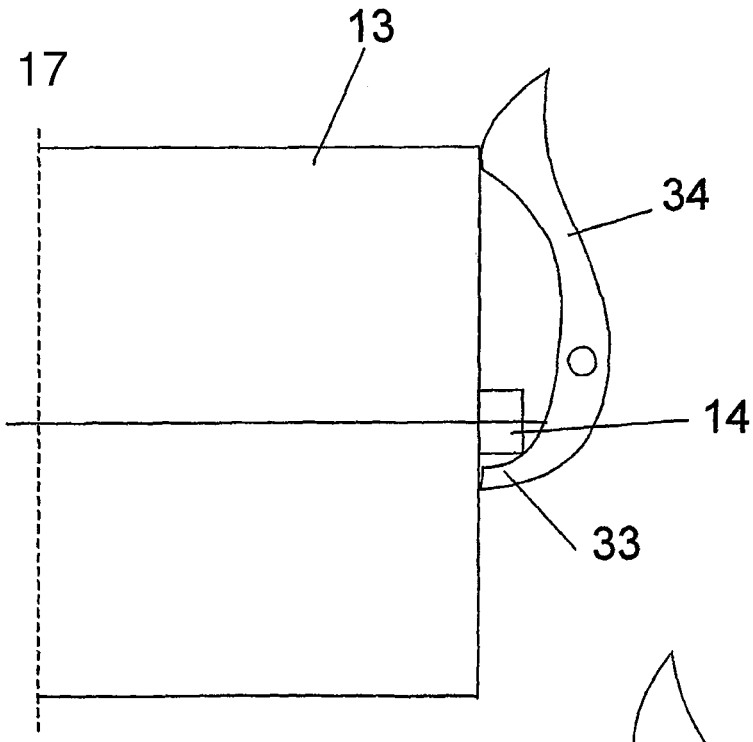
Figure 18:
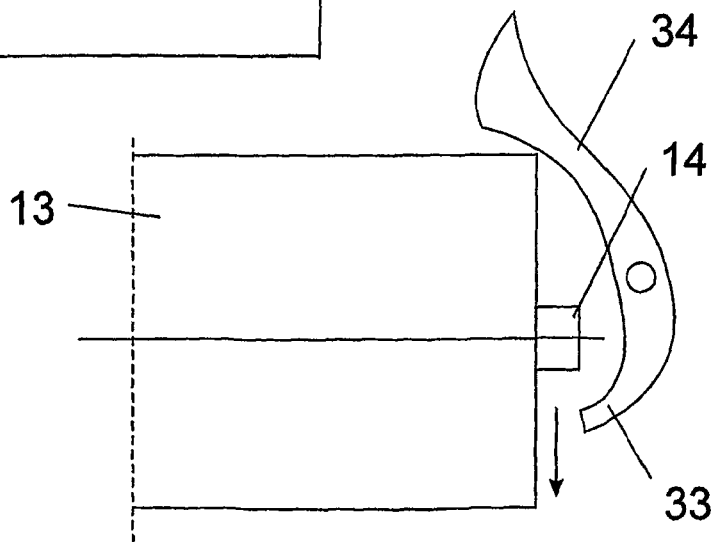

FIGS. 16 to 18 diagrammatically show an axial constriction as an alternative solution for the radial first constriction 7 with an angled lever 34, the first arm of which protrudes axially into the receiving groove 16 and the second arm of which bears on the end side against the reserve reel 13. As FIG. 16 shows, the lever 34 is pivoted by the inserted reserve reel 13, with the result that the bearing journal 14 lies on the supporting element 33 of the lever 34 (FIG. 17). As soon as the diameter of the reserve reel 13 is small enough, as FIG. 18 shows, the lever 34 can pivot back again under the action of a non-illustrated spring and releases the bearing journal 14, with the result that the reserve reel 13 can slide downward out of the storage position into the dispensing position.

Figure 19:
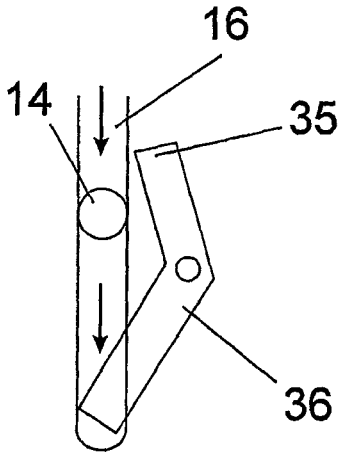
FIGS. 19 to 20 are illustrations showing details for retaining the dispensing reel in an auxiliary dispensing position in a fourth embodiment of the paper dispenser.
Figure 20:
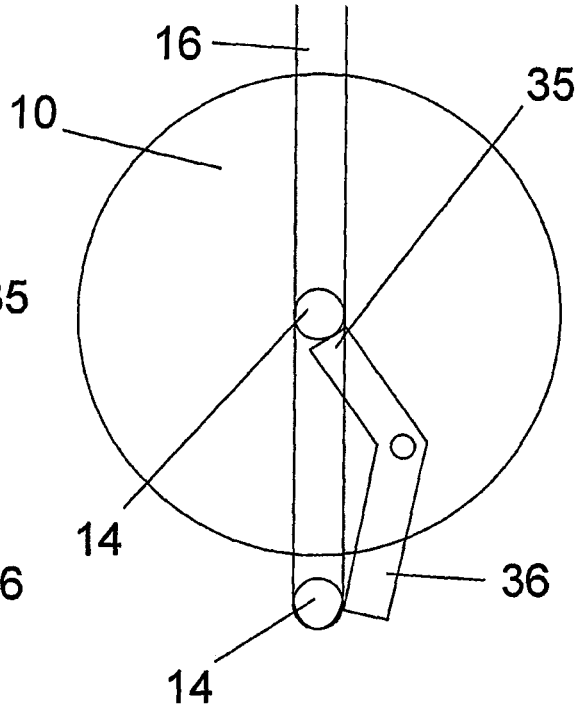

FIG. 19 shows an embodiment, in which the dispensing position lies at the lowermost end of the receiving groove 16. The last section of the receiving groove 16 is assigned an angled lever 36 which is mounted rotatably and is pressed by a non-illustrated spring into the position which can be seen from FIG. 19 and in which the end of the lower second arm protrudes into the receiving groove 16. The bearing journal 14 of the reel can slide as far as the end, at which it pivots the lever 36, with the result that the upper first arm pivots laterally into the receiving groove 16 and forms a radial constriction. As long as the empty core or mandrel lies in the dispenser, the upper first arm of the lever 36 forms a supporting element 35 for the bearing journal 14 of a first reel 11 in an auxiliary dispensing position which lies so far above the dispensing position that the reel 10 does not touch the empty core. If the latter is removed, the lever 36 pivots back, cancels the constriction, and the reel 10 slides deeper downward into the dispensing position.

The invention claimed is:

1. A paper dispenser, comprising:

a housing having an outlet opening formed therein for paper from a first reel lying in a dispensing position in the outlet opening; and a guide leading into said dispensing position from a storage position for a reserve reel of a first initial diameter;

said guide including a constricted region entirely disposed above said outlet opening and defining said storage position, the width of said constricted region being less than the first initial diameter, whereby the reserve reel cannot pass through said constriction into said dispensing position until the diameter of the reserve reel has been reduced from the first initial diameter by use of paper on said reserve reel; and said outlet opening having a size which, after paper of the first reel has been used up, makes it possible to access, by hand, paper of the reserve reel contained in the storage position above said outlet opening.

2. The paper dispenser according to claim 1, wherein a height of an accessible portion of said outlet opening increases as a diameter of the first reel decreases.

3. The paper dispenser according to claim 1, wherein said constricted region has a width corresponding at most to half a diameter of the reserve reel.

4. The paper dispenser according to claim 1, wherein said guide has a further constricted region and said dispensing position of the first reel is defined by said further constricted region.

5. The paper dispenser according to claim 4, wherein said further constricted region has a width in said guide corresponding to a diameter of a core of the first reel.

6. The paper dispenser according to claim 4, further comprising braking tabs, said constricted region and said further constricted region each being formed by one of said braking tabs which presses against a circumference of the first reel and the reserve reel in a sprung manner.

7. The paper dispenser according to claim 6, wherein said braking tab has surface roughnesses which increase friction.

8. The paper dispenser according to claim 1, wherein said dispensing position of the first reel is disposed at an end of said guide.

9. The paper dispenser according to claim 8, wherein said guide track has a receiving groove formed therein for receiving a bearing journal of a core or mandrel, the bearing journal protruding from the reel.

10. The paper dispenser according to claim 8, further comprising a reel brake, said storage position of at least one of the reserve reel and said dispensing position of the first reel being assigned said reel brake which acts on an end side.

11. A method for removing paper by hand from a paper dispenser, which comprises the steps of:

providing a first reel lying in a dispensing position in an outlet opening of the housing, a guide leading into the dispensing position and a reserve reel lying at a constricted region of the guide in a storage position, the constricted region being entirely disposed above the outlet opening;

using up paper of the first reel; and after the first reel has been used up, pulling off the paper of the reserve reel in the storage position until the reserve reel can pass the constricted region, and in that the paper is used up now from the dispensing position.

* * * * *